US012168868B2

(12) United States Patent
Pellock et al.

(10) Patent No.: US 12,168,868 B2
(45) Date of Patent: Dec. 17, 2024

(54) VALLEY CLIP FOR VALLEY TRUSS CONNECTIONS OF A ROOF SYSTEM

(71) Applicant: PT-Enginuity, LLC, Edwardsville, IL (US)

(72) Inventors: Michael Alex Pellock, Edwardsville, IL (US); Herbert Larry Troyer, Greenville, SC (US)

(73) Assignee: PT-Enginuity, LLC, Edwardsville, IL (US)

( * ) Notice: Subject to any disclaimer, the term of this patent is extended or adjusted under 35 U.S.C. 154(b) by 16 days.

(21) Appl. No.: 17/866,650

(22) Filed: Jul. 18, 2022

(65) Prior Publication Data

US 2023/0065175 A1 Mar. 2, 2023

Related U.S. Application Data

(60) Provisional application No. 63/237,253, filed on Aug. 26, 2021.

(51) Int. Cl.

| | |
|---|---|
| ***E04B 1/38*** | (2006.01) |
| ***E04B 7/02*** | (2006.01) |
| ***E04B 7/06*** | (2006.01) |

(52) U.S. Cl.

CPC ..... *E04B 1/388* (2023.08); *E04B 7/022* (2013.01); *E04B 7/06* (2013.01); *E04B 2001/389* (2023.08)

(58) Field of Classification Search

CPC . E04B 1/388; E04B 7/022; E04B 7/06; E04B 2001/389

See application file for complete search history.

(56) References Cited

U.S. PATENT DOCUMENTS

| | | | | |
|---|---|---|---|---|
| 3,499,673 | A * | 3/1970 | Soltysik | E04D 3/3601 52/509 |
| 5,217,317 | A * | 6/1993 | Young | F16B 9/052 403/14 |
| 5,913,788 | A * | 6/1999 | Herren | E04B 2/825 52/236.7 |
| 6,058,668 | A * | 5/2000 | Herren | E04B 2/825 52/236.7 |
| 6,171,043 | B1 * | 1/2001 | Williams | F16B 15/0046 52/712 |
| 9,476,194 | B1 * | 10/2016 | Hulka | E04B 9/22 |
| 2022/0136230 | A1 | 5/2022 | Pellock et al. | |

* cited by examiner

*Primary Examiner* — Patrick J Maestri

(74) *Attorney, Agent, or Firm* — Clements Bernard Walker; Christopher L. Bernard; Devin Cummins

(57) ABSTRACT

A valley clip for a valley truss to deck panel connection of a roof system is disclosed. The valley clip includes a base and a tab. The base includes a plate shape. The base is adapted to fasten to one or more ribs of the deck panel. The tab includes an end connected to the base. The tab is adapted to rotate relative to the base into a vertical position for fastening to a side of a bottom chord of the valley truss.

19 Claims, 5 Drawing Sheets

VALLEY CLIP FOR VALLEY TRUSS CONNECTIONS OF A ROOF SYSTEM

FIELD OF THE DISCLOSURE

The present disclosure generally relates to truss connections of a roof system. More particularly, the present disclosure relates to valley truss connections with a valley clip.

BACKGROUND OF THE DISCLOSURE

Roof systems often include valleys created by the addition of valley trusses. Valley trusses are either applied directly to common trusses below or, in many cases, to a deck connected to the common truss. Decks, such as metal decks, often have profiles, such as corrugations, and are often installed at a sloped angle, which can result in the valley truss to deck connection being difficult to form.

BRIEF SUMMARY OF THE DISCLOSURE

In accordance with the present disclosure, the present disclosure relates to a roof system with a valley truss to deck connection formed using a valley clip. The valley clip includes a tab that is rotatable, such that the tab is adapted to be positioned at a desired angle to be parallel to a side of the valley truss allowing the valley truss to be fastened to the valley clip, which is fastened to the deck to form a joint between the valley truss and the deck.

In one exemplary embodiment, the present disclosure provides a valley clip for a valley truss to deck panel connection of a roof system, the valley clip including: a base including a plate shape, the base being adapted to fasten to one or more ribs of the deck panel; and a tab including an end connected to the base, the tab being adapted to rotate relative to the base into a position for fastening to a side of a bottom chord of the valley truss. The tab is adapted to rotate to any position relative to the base. The tab is unitarily formed with the base from a singular plate of material. Rotation of the tab occurs by bending material where the end of the tab is connected to the base. The tab and the base further comprise one or more fastening holes. The connection between the base and the tab is centrally located and the base completely surrounds the tab. One or more perforations are formed along the connection between the base and the tab. Stress relief features are formed adjacent to ends of the connection between the base and the tab. The base is adapted to support weight of the valley truss via contact between a bottom of the bottom chord and the base.

In another embodiment, the present disclosure provides a valley truss to deck panel connection including: a valley truss; a deck panel including one or more flutes and ribs; and a valley clip including; a base including a plate shape, the base being adapted to fasten to the one or more ribs of the deck panel; and a tab including an end connected to the base, the tab being adapted to rotate relative to the base into a position for fastening to a side of a bottom chord of the valley truss. The tab is adapted to rotate to any position relative to the base. The tab is unitarily formed with the base from a singular plate of material. Rotation of the tab occurs by bending material where the end of the tab is connected to the base. The tab and the base further comprise one or more fastening holes. The connection between the base and the tab is centrally located and the base completely surrounds the tab. One or more perforations are formed along the connection between the base and the tab. Stress relief features are formed adjacent to ends of the connection between the base and the tab. The base is adapted to support weight of the valley truss via contact between a bottom of the bottom chord and the base.

In a further embodiment, the present disclosure provides a method for forming a valley truss to deck panel connection of a roof system, the method including steps of: securing a base of a valley clip to one or more ribs of a deck panel; rotating a tab connected to the base into a position; and connecting the tab to a side of a bottom chord of the valley truss. The tab is rotated to be parallel to the side of the bottom chord of the valley truss. The connecting of the tab to the side of the bottom chord ensures that the weight of the valley truss is supported via contact between a bottom of the bottom chord and the base. Rotation of the tab occurs by bending material where the end of the tab is connected to the base.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION OF THE DISCLOSURE

In various embodiments, the present disclosure relates to a roof system with a valley truss to deck connection formed using a valley clip. The valley clip includes a tab that is rotatable, such that the tab is adapted to be positioned at a desired angle to be parallel to a side of the valley truss allowing the valley truss to be fastened to the valley clip, which is fastened to the deck to form a joint between the valley truss and the deck.

Figure 1:
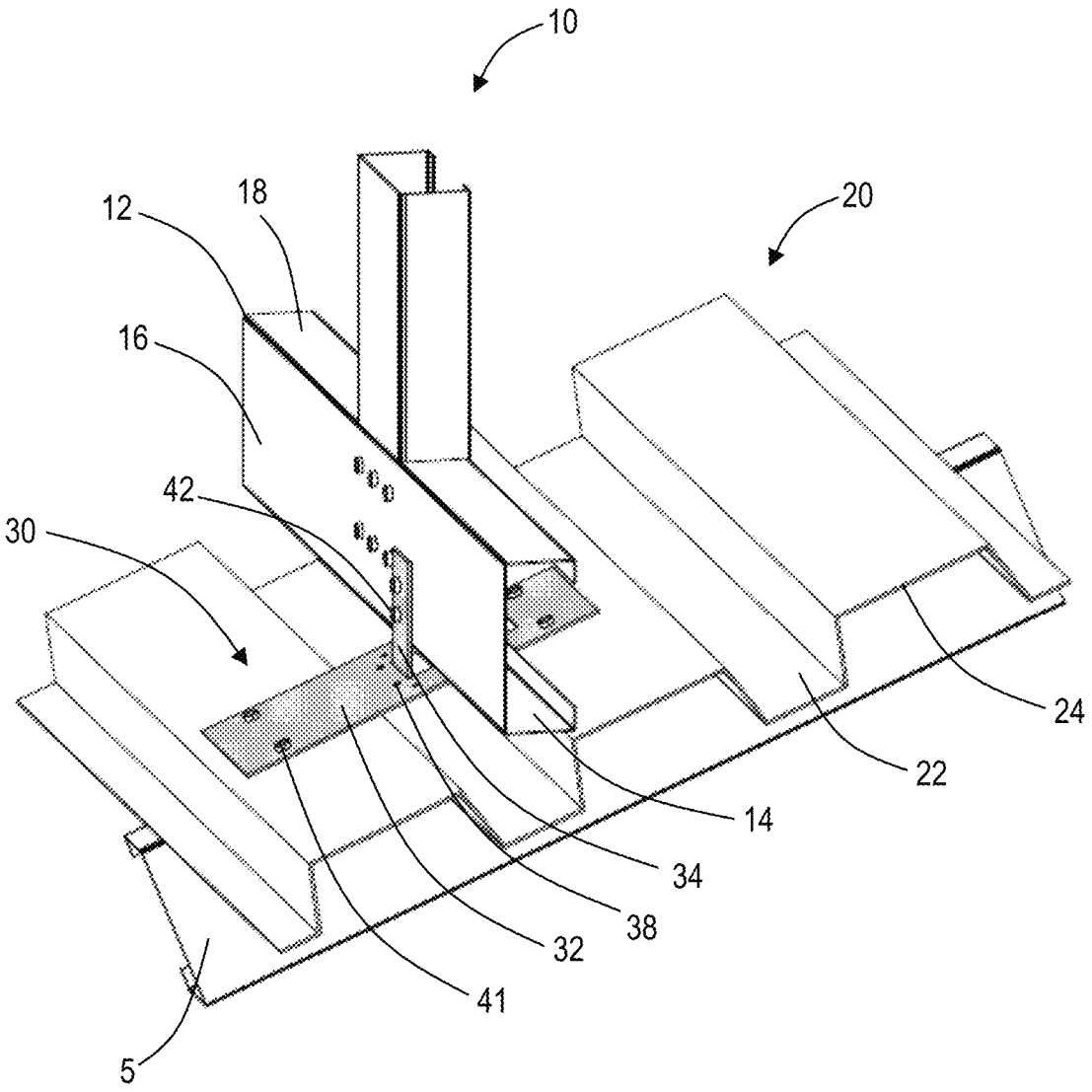
FIG. 1 is a perspective view of an illustrative embodiment of a valley truss to deck panel connection of a roof system highlighting a valley truss over deck flute connection.

FIG. 1 is a perspective view of an illustrative embodiment of a valley truss 10 to deck panel 20 connection of a roof system highlighting a valley truss 10 over deck flute 22 connection. Referring now to FIG. 1, in embodiments, the roof system includes a deck panel 20, a valley truss 10, and a valley clip 30. As illustrated in FIG. 1, in embodiments, the deck panel 20 is corrugated with alternating flutes 22 and ribs 24 where the flutes 22 form troughs between the ribs 24. In some embodiments, the deck panel 20 is formed of corrugated metal. In embodiments, the deck panel 20 is supported by one or more common trusses 5 and forms part of a sloped roof.

The valley truss 10 includes a bottom chord 12 that connects to the deck panel 20 via one or more valley clips 30. In embodiments, the bottom chord 12 includes a bottom 14 that is perpendicular to the sides 16 thereof, where the bottom 14 is not parallel to the general angle of the deck panel 20 and the sides 16 are not perpendicular to the general angle of the deck panel 20. In some embodiments, the bottom chord extends vertically (where the top 18 is directly above the bottom 14).

Each valley clip 30 includes a base 32 and a tab 34. The base 32 includes a flat plate shape. The base 32 includes fastening holes 38 for securing the valley clip 30 to the deck panel 20. In the embodiments illustrated, the base 32 and tab 34 include fastening holes 38, the fastening holes 38 in the base 32 being adjacent each end thereof and adjacent to the tab 34. In some embodiments, the base 32 includes one or more of a reinforcing ribs and bends for increasing a rigidity thereof. The tab 34 is connected to the base 32 at one end of the tab 34. The tab 34 is adapted to rotate relative to the base 32. In some embodiments, the tab 34 is unitarily formed with the base 32, such as formed from a singular plate of metal or other material of the like and the rotation of the tab 34 occurs by bending the material that connects the tab 34 to the base 32.

The base 32 of the valley clip 30 is fastened to at least one rib 24 of the deck panel 20. In the embodiment illustrated in FIG. 1, the valley clip 30 is secured to adjacent ribs 24 via fasteners 41 and spans across the flute 22 between the ribs 24. The tab 34 is rotated into a vertical position, parallel or substantially parallel to a side 16 of the bottom chord 12. By being substantially parallel, the tab 34 and the side 16 are sufficiently aligned in order to fasten the tab 34 and the side 16 together. The tab 34 and the side 16 are joined together via fasteners 42. With the tab 34 secured to the side 16, the valley truss 10 is secured to the deck panel 20 and held in place by the tab 34 and is positioned over the flute 22. In some embodiments, the weight of the valley truss 10 is supported via contact between the bottom 14 of the bottom chord 16 and the base 32, while the tab 34 ensures that the bottom chord 16 does not slip along the base 32.

It will be appreciated that the valley clip 30 of the present disclosure can be manufactured from any rigid material known to one of skill in the art. Additionally, the valley clip 30 of the present disclosure can be adapted to be compatible with any truss of varying size or shape, and is not limited to the C-stud type steel truss shown in FIG. 1. Those skilled in the art will recognize several other shapes of truss members that the valley clip 30 would also be compatible with, as well as wood trusses or trusses of other materials.

Figure 2:
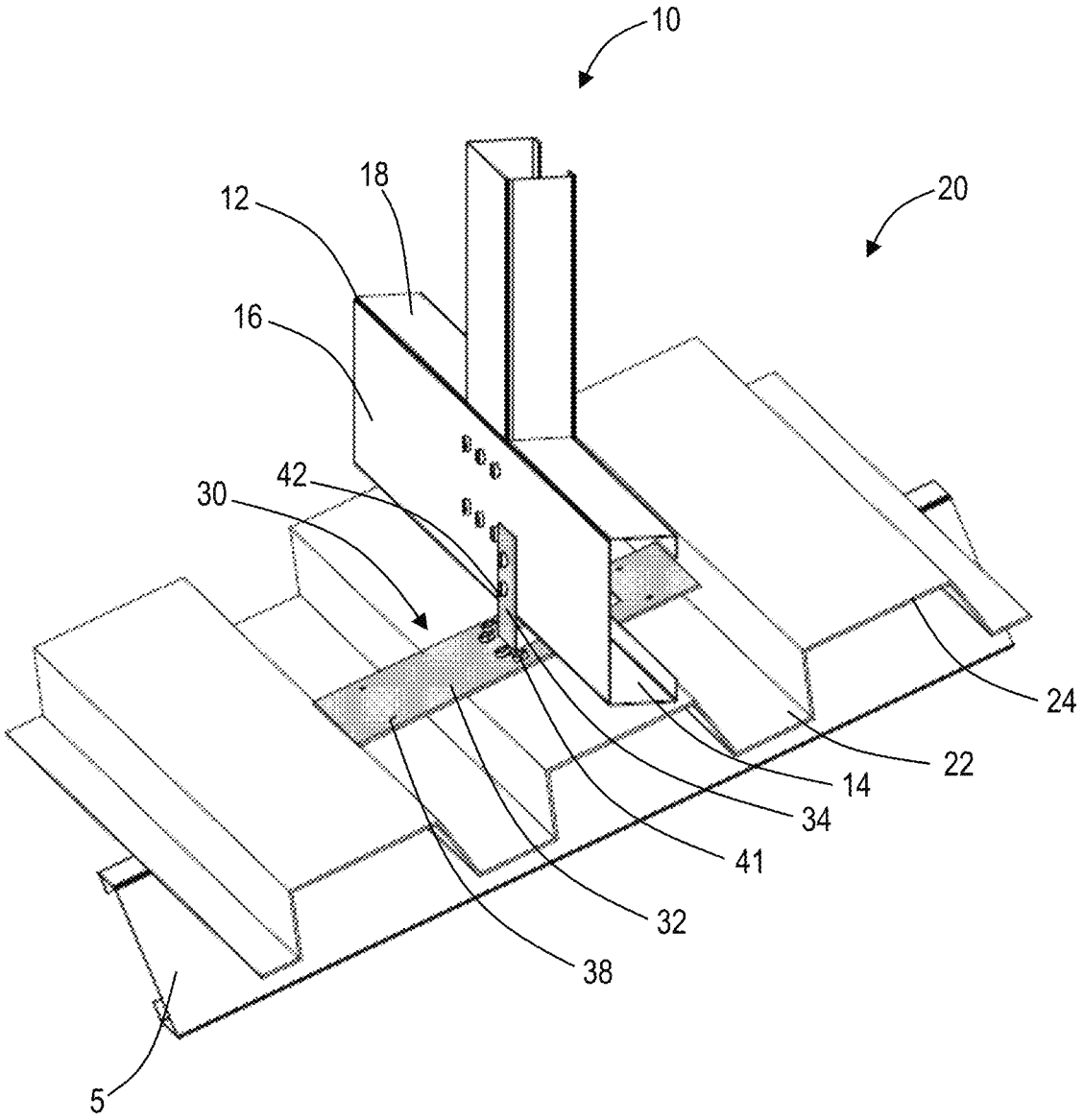
FIG. 2 is a perspective view of another illustrative embodiment of a valley truss to deck panel connection of the roof system highlighting a valley truss between deck flute connection.

FIG. 2 is a perspective view of another illustrative embodiment of a valley truss 10 to deck panel 20 connection of the roof system highlighting a valley truss 10 between deck flute 22 connection. Referring now to FIG. 2, in the embodiment illustrated, the valley clip 30 is secured to a single rib 24 utilizing fastening holes 38 that are adjacent to the tab 34, which secures the valley truss 10 over the rib 24. Further arrangements are also contemplated, where the base 32 is secured to adjacent ribs via the fastening holes 38 in one end and via the fastening holes adjacent to the tab 34 (or the other end) and the valley truss 10 is held in a position by the tab 34 that is partially over the rib 24 and partially over the flute 22.

Figure 3:
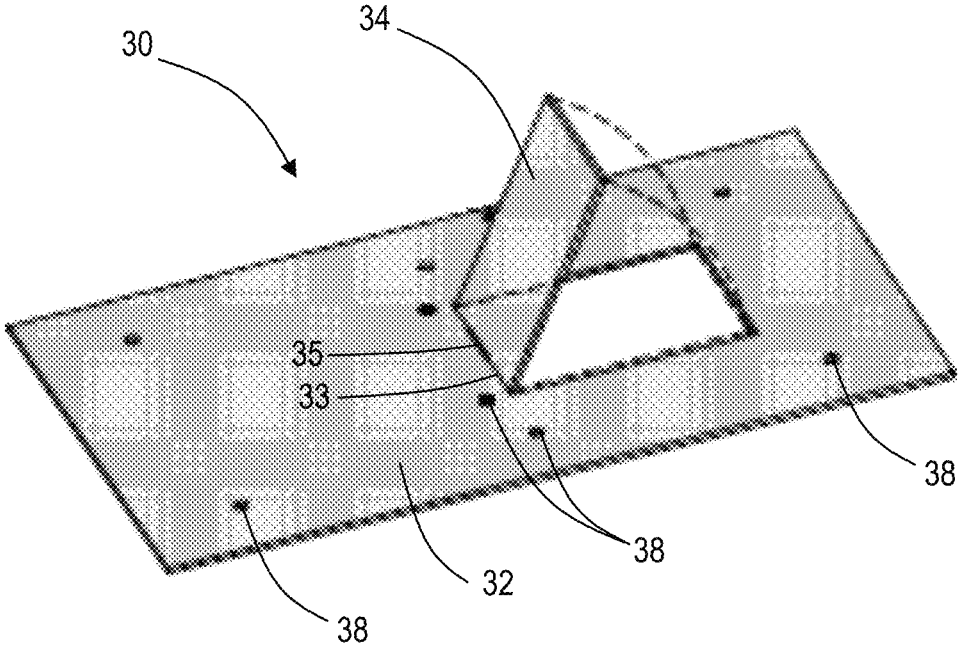
FIG. 3 is a perspective view of an illustrative embodiment of the valley clip of FIGS. 1 and 2.
Figure 4:
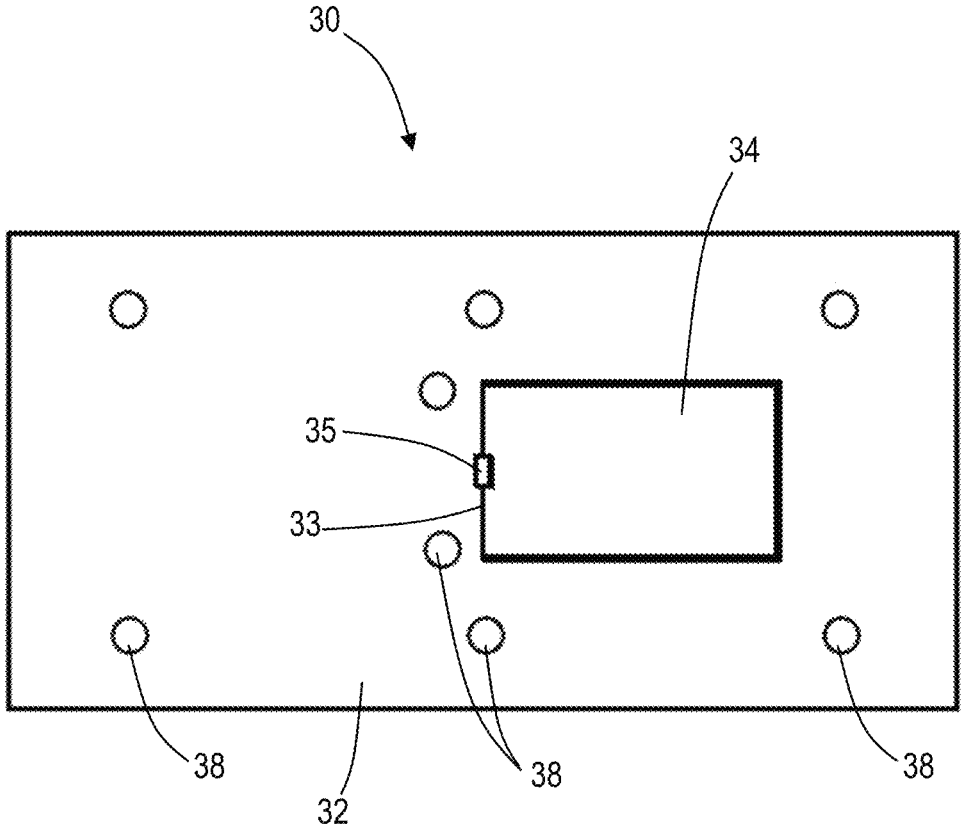
FIG. 4 is a top view of the valley clip of FIG. 3.

FIG. 3 is a perspective view of an illustrative embodiment of the valley clip 30 of FIGS. 1 and 2. FIG. 4 is a top view of the valley clip of FIG. 3. Referring to FIGS. 3 and 4, in embodiments, the connection 33 between the base 32 and the tab 34 is centrally located and the base 32 completely surrounds the tab 34. In some embodiments, the sides and the free end of the tab 34 (opposite the end connected to the base) are formed by cutting the sides and the free end from the base 32 and the tab 34 being rotated up leaves a void in the base 32. Those skilled in the art will recognize modifications to the based 32 are contemplated herewith. For example, the addition of stiffening ribs or a small flange to the outer edges of the base 32 adapted to increase the stiffness of the base 32 and the tab 34 for that matter are contemplated in other embodiments of the present valley clip 30. Rounding corners, adding stiffeners, or any other minor modification that is within the scope of this disclosure are also contemplated herein.

In some embodiments, as illustrated in FIGS. 3 and 4, one or more perforations 35 are formed along the connection 33 between the base 32 and the tab 34. The perforations 35 are adapted to allow the connection 33 to bend and are sized to ensure that there is sufficient material in the connection 33 to ensure that the tab 34 does not break away from the base 32. In some embodiments, stress relief features are formed adjacent to ends of the connection 33, in the base 32 adjacent to the corners of the tab 34 adjoining the base 32.

Figure 5:
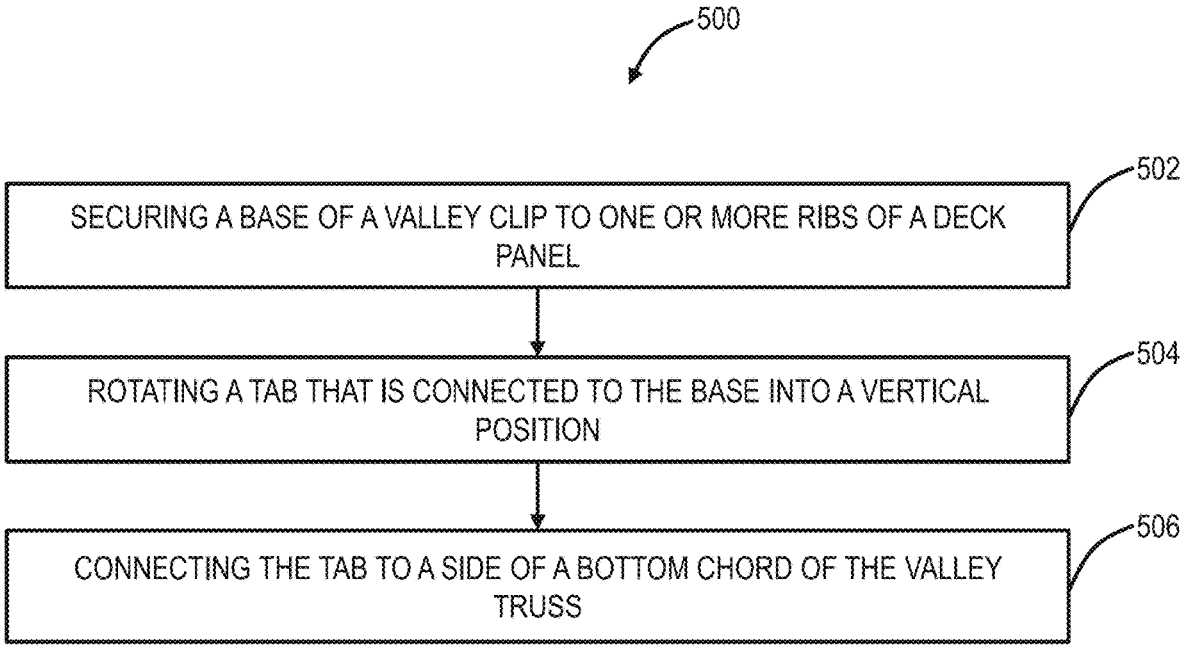
FIG. 5 is a method for forming a valley truss to deck panel connection of a roof system.

FIG. 5 is a method 500 for forming a valley truss to deck panel connection of a roof system. The method 500 includes securing a base of a valley clip to one or more ribs of a deck panel at step 502. The method 500 also includes rotating a tab that is connected to the base into a vertical position at step 504. In embodiments, the rotating is performed by bending the connection between the tab and the base. The method 500 further includes connecting the tab to a side of a bottom chord of the valley truss at step 506. In some embodiments, step 506 is performed after a bottom of the bottom chord is brought into contact with the base.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. A valley clip for a valley truss to deck panel connection of a roof system, the valley truss having a bottom chord, and the valley clip comprising:

a base including a plate shape defining a plurality of fastening holes, a portion of the plurality of fastening holes defined adjacent to each of two opposing ends of the base, the base being adapted to fasten to one or more ribs of the deck panel; and a tab including an end connected to the base at a connection between the base and the tab, the connection centrally located such that the base completely surrounds the tab, and the tab being adapted to rotate relative to the base into a position substantially parallel to a side of the bottom chord such that the side and the tab are substantially aligned in order to fasten the tab and the side together, for fastening to the valley truss, wherein the valley clip is configured such that utilization of the portion of the plurality of fastening holes defined adjacent to each of the two opposing ends of the base to fasten the base to two adjacent ribs of the deck panel positions the tab over a flute defined between the two adjacent ribs of the deck panel.

2. The valley clip of claim 1, wherein the tab is adapted to rotate relative to the base into a vertical position.

3. The valley clip of claim 1, wherein the tab is unitarily formed with the base from a singular plate of material.

4. The valley clip of claim 1, wherein rotation of the tab occurs by bending material where the end of the tab is connected to the base.

5. The valley clip of claim 1, wherein one or more perforations are formed along the connection between the base and the tab.

6. The valley clip of claim 1, wherein stress relief features are formed adjacent to ends of the connection between the base and the tab.

7. The valley clip of claim 1, wherein the base is adapted to support weight of the valley truss via contact between a bottom of the valley truss and the base.

8. The valley clip of claim 1, wherein a second portion of the plurality of fastening holes is defined adjacent to the tab, and wherein the valley clip is configured such that utilization of the second portion of the plurality of fastening holes defined adjacent to the tab to fasten the base to a single rib of the deck panel positions the tab over the single rib of the deck panel.

9. A valley clip for a valley truss to deck panel connection of a roof system, the valley truss having a bottom chord, and the valley clip comprising;

a base including a plate shape defining a plurality of fastening holes, a portion of the plurality of fastening holes defined adjacent to each of two opposing ends of the base, the base being adapted to fasten to one or more ribs of the deck panel; and a tab including an end connected to the base at a connection between the base and the tab with one or more perforations formed along the connection between the base and the tab, the tab being adapted to rotate relative to the base into a position substantially parallel to a side of the bottom chord such that the side and the tab are substantially aligned in order to fasten the tab and the side together, for fastening to the valley truss, wherein the valley clip is configured such that utilization of the portion of the plurality of fastening holes defined adjacent to each of the two opposing ends of the base to fasten the base to two adjacent ribs of the deck panel positions the tab over a flute defined between the two adjacent ribs of the deck panel.

10. The valley clip of claim 9, wherein the tab is adapted to rotate relative to the base into a vertical position.

11. The valley clip of claim 9, wherein the tab is unitarily formed with the base from a singular plate of material.

12. The valley clip of claim 9, wherein rotation of the tab occurs by bending material where the end of the tab is connected to the base.

13. The valley clip of claim 9, wherein the base is adapted to support weight of the valley truss via contact between a bottom of the valley truss and the base.

14. The valley clip of claim 9, wherein a second portion of the plurality of fastening holes is defined adjacent to the tab, and wherein the valley clip is configured such that utilization of the second portion of the plurality of fastening holes defined adjacent to the tab to fasten the base to a single rib of the deck panel positions the tab over the single rib of the deck panel.

15. A method for forming a valley truss to deck panel connection of a roof system, the method comprising steps of:

securing a base, including a plate shape defining a plurality of fastening holes, a portion of the plurality of fastening holes defined adjacent to each of two opposing ends of the base, of a valley clip to one or more ribs of a deck panel, wherein utilization of the portion of the plurality of fastening holes defined adjacent to each of the two opposing ends of the base to fasten the base to two adjacent ribs of the deck panel positions a tab connected to the base over a flute defined between the two adjacent ribs of the deck panel;

rotating the tab connected to the base into a position substantially parallel to a side of a bottom chord of the valley truss such that the side and the tab are substantially aligned in order to fasten the tab and the side together; and connecting the tab to the valley truss.

16. The method of claim 15, wherein the connecting of the tab to the valley truss ensures that the weight of the valley truss is supported via contact between a bottom of the valley truss and the base.

17. The method of claim 15, wherein rotation of the tab occurs by bending material where the end of the tab is connected to the base.

18. A valley clip for a valley truss to deck panel connection of a roof system, the valley truss having a bottom chord, and the valley clip comprising:

a base including a plate shape defining a plurality of fastening holes, a portion of the plurality of fastening holes defined adjacent to each of two opposing ends of the base, the base being adapted to fasten to one or more ribs of the deck panel; and a tab including an end connected to the base at a connection between the base and the tab, wherein stress relief features are formed adjacent to ends of the connection between the base and the tab, and the tab being adapted to rotate relative to the base into a position substantially parallel to a side of the bottom chord such that the side and the tab are substantially aligned in order to fasten the tab and the side together, for fastening to the valley truss, wherein the valley clip is configured such that utilization of the portion of the plurality of fastening holes defined adjacent to each of the two opposing ends of the base to fasten the base to two adjacent ribs of the deck panel positions the tab over a flute defined between the two adjacent ribs of the deck panel.

19. The valley clip of claim 18, wherein a second portion of the plurality of fastening holes is defined adjacent to the tab, and wherein the valley clip is configured such that utilization of the second portion of the plurality of fastening holes defined adjacent to the tab to fasten the base to a single rib of the deck panel positions the tab over the single rib of the deck panel.

* * * * *